US006247606B1

(12) United States Patent
Zogg

(10) Patent No.: US 6,247,606 B1
(45) Date of Patent: Jun. 19, 2001

(54) HIGH STRENGTH CONTAINER

(75) Inventor: Jon R. Zogg, Westfield, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 09/401,642

(22) Filed: Sep. 22, 1999

Related U.S. Application Data

(63) Continuation of application No. 09/174,161, filed on Oct. 16, 1998, now abandoned, which is a continuation of application No. 08/803,296, filed on Feb. 20, 1997, now abandoned.

(51) Int. Cl.[7] ..... B65D 1/02
(52) U.S. Cl. ..... 215/385
(58) Field of Search ..... 215/396, 398, 215/382, 383, 384, 385; 220/669, 671, 675, 755, 771

(56) References Cited

U.S. PATENT DOCUMENTS

| | | | | |
|---|---|---|---|---|
| D. 38,430 | * | 1/1907 | Pressing . | |
| D. 333,433 | * | 2/1993 | Segati | D9/531 |
| D. 347,175 | * | 5/1994 | Segati | D9/531 |
| 4,193,699 | * | 3/1980 | Haygeman et al. | 366/130 |
| 4,372,455 | * | 2/1983 | Cochran | 215/385 |
| 4,572,384 | * | 2/1986 | Vesborg | 215/385 |
| 4,609,106 | * | 9/1986 | Gentili | 206/509 |
| 4,765,514 | * | 8/1988 | Berglund . | |
| 4,804,119 | * | 2/1989 | Goodall | 222/468 |
| 4,858,758 | * | 8/1989 | Mitchell et al. | 206/205 |
| 5,156,285 | * | 10/1992 | Zogg et al. | 215/384 |
| 5,366,101 | * | 11/1994 | Krall et al. | 215/398 |

FOREIGN PATENT DOCUMENTS

| | | | | |
|---|---|---|---|---|
| 9212023 | * | 11/1992 | (DE) . | |
| 2127375 | * | 4/1984 | (GB) | 215/383 |

OTHER PUBLICATIONS

PCT Search Report; Jun. 8, 1998.*
Photographs of "Perwoll" bottle, no date.*

* cited by examiner

*Primary Examiner*—Stephen Castellano
(74) *Attorney, Agent, or Firm*—Michael J. McGreal

(57) ABSTRACT

The containers have a length greater than the width and have a front wall, a rear wall, and connecting sidewalls. The container is closed at the bottom by a bottom wall and has a dispensing channel at a top end. Between the front wall and sidewalls and rear wall and sidewalls, there are concave transition walls. The concave transition walls extend at least half the distance from the bottom wall to the dispensing channel. The container has a handle formed by an aperture in the front wall extending to the rear wall, an aperture wall connecting the front wall and rear wall. At least partially surrounding the aperture there is an aperture concave transition wall. The concave transition walls provide increased longitudinal and lateral strength to the container. The bottom wall preferably has one or more concave recesses. These will be laterally and longitudinally in the base surface. The handle walls which includes the bottle sidewall are in a vertical orientation to function as a column and to better transfer forces on an upper part of the container to the base.

11 Claims, 7 Drawing Sheets

HIGH STRENGTH CONTAINER

This is a continuation of prior application U.S. Ser. No. 9/174,161 filed Oct. 16, 1998, now abandoned, which was a continuation of U.S. Ser. No. 8/803,296 filed Feb. 20, 1997, now abandoned, which application is are incorporated herein by reference.

FIELD OF THE INVENTION

This invention relates to high strength, lightweight containers. More particularly, this invention relates to containers that have a high longitudinal and lateral strength and a reduced lateral deformation when filled with a substance.

BACKGROUND OF THE INVENTION

There is a continuing need for lightweight containers that have a high longitudinal and lateral strength. A high longitudinal and lateral strength container resists both bulging and paneling. Paneling is when some of the head space gases are absorbed by the contents of the bottle to create a slight vacuum. This can cause the front or rear wall to buckle inwardly. A container will bulge when the wall strength is less than the force exerted on the container walls by a contained substance or from container stacking. Both of these effects are problems. Each changes the original shape of the container.

There also is a need for lightweight, high strength containers at the manufacturing and distribution levels. The containers must be sufficiently strong to withstand the forces during filling and handling, and then later during distribution when packing cases and/or the containers will be stacked, one on the other. Also there must be a sufficient strength when handled by the consumer during use. The container must retain its integrity so that there will be no spills or other such events.

There is a continuing need for containers that have a lighter weight. This results in a lower cost and less material to recycle once the container is emptied of its contents. The problem is how to make a lightweight container that will substantially retain its shape during usage, that is, how to make a bottle that has a high lateral and longitudinal strength. These are competing objectives.

This problem is partially addressed by the Perwoll product bottle. This is a German product. In this bottle there are front and rear walls and connecting sidewalls. There also are flat sections between each of these walls. This bottle partially solves the problem. However, in order to get lightweight container and high longitudinal and lateral strength between the front wall and the sidewalls, and between the rear wall and the sidewalls, there should be concave transition walls. A concave shape to a transition wall increases the strength of the container both laterally and longitudinally. In addition, it has been found that the handle area can likewise be strengthened if between the wall of the handle area and the front, rear and sidewalls, there also is a concave transition wall. That is, in any transition from one container wall to another container wall there should be a concave transition wall. A transition wall with a concave structure permits the use of less container material but yet retains the overall container strength.

BRIEF SUMMARY OF THE INVENTION

The container has a front wall, a rear wall and sidewalls connecting the front wall and the rear wall. The container is closed at the bottom end by a bottom wall with a dispensing channel at the other end. Between the front wall and each sidewall, and the rear wall and each sidewall, there is a concave transition wall. The concave transition wall extends from about the bottom wall up to at least about half the distance to the dispensing channel. In an upper part of the container the concave transition walls can merge into the structure of the container.

The container has a handle which preferably is comprised of an aperture in the front wall which extends to the rear wall. An aperture wall connects the front wall to the rear wall. Between the aperture wall and the front wall and the aperture wall and the rear wall, there are concave aperture transition walls. In the handle area of the container the concave transition wall for purposes of the extension up the container includes the aperture concave transition walls which also strengthen the handle side of the container.

The concave transition walls and the aperture concave transition walls serve to increase the lateral strength of the container. These concave transition walls reduce the longitudinal and lateral distortion of the container when the container is filled with a substance. Also, they provide for a handle that undergoes minimal deformation when the handle is gripped.

The upper part of the container in a preferred embodiment will have a dome shape with hyperbolic walls. The hyperbolic walls transfer longitudinal forces on the container downwardly to the body of the container and to the walls of the container with the concave transition walls functioning as columns to assist in the transfer of the longitudinal forces to the base and the bottom wall.

The bottom wall preferably will have at least one longitudinal concave portion and at least one concave lateral portion. More preferably for larger size containers, there are at least two concave lateral portions. The concave portions increase the strength of the bottom of the container.

DETAILED DESCRIPTION OF THE DRAWINGS

The invention will now be described with specific reference to the drawings.

Figure 1:
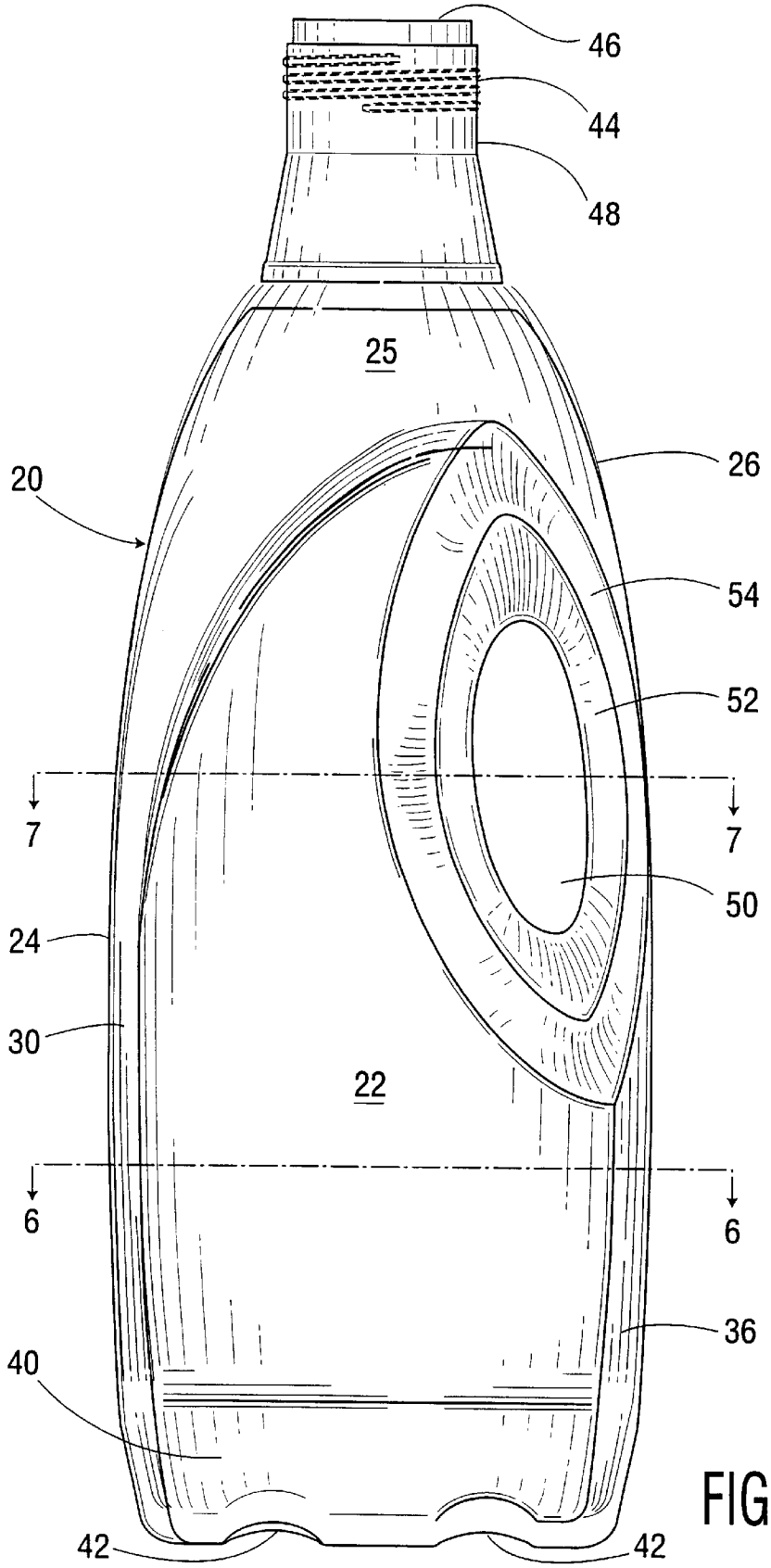
FIG. 1 is an elevational view of the container.

In FIG. 1 there is shown a is a front elevational view of a container of the present invention. The container 20 has a front wall 22, right sidewall 26 and left sidewall 24. At the lower end there is a base 40 with two concave recesses 42. The top portion 25 of the body of the container is dome shaped with hyperbolic shaped walls. At an upper part of the top portion, there is a cylindrical section 48 which has threads 44. Aperture 46 is for filling and dispensing materials from the bottle.

Between the front wall 22 and the sidewall 24 there is a concave transition wall 30 and between the front wall 22 and sidewall 26 there is a concave transition wall 36. These concave transition walls provide both longitudinal and lateral strength to the bottle. The concave transition walls extend from the base 40 up to the upper portion of the bottle 25. At this point the concave transition walls merge into the structure of this part of the container. The base of the bottle has concave recesses 42 which add strength to this part of the container.

The container also has a handle which is comprised of aperture 50 which extends through the bottle. This aperture extends from front wall 22 through to the rear of the container. Aperture wall 52 connects to the front wall and rear wall by means of concave aperture transition wall 54. This concave aperture transition wall strengthens the sidewall 26 in the area of aperture 50.

Figure 2:
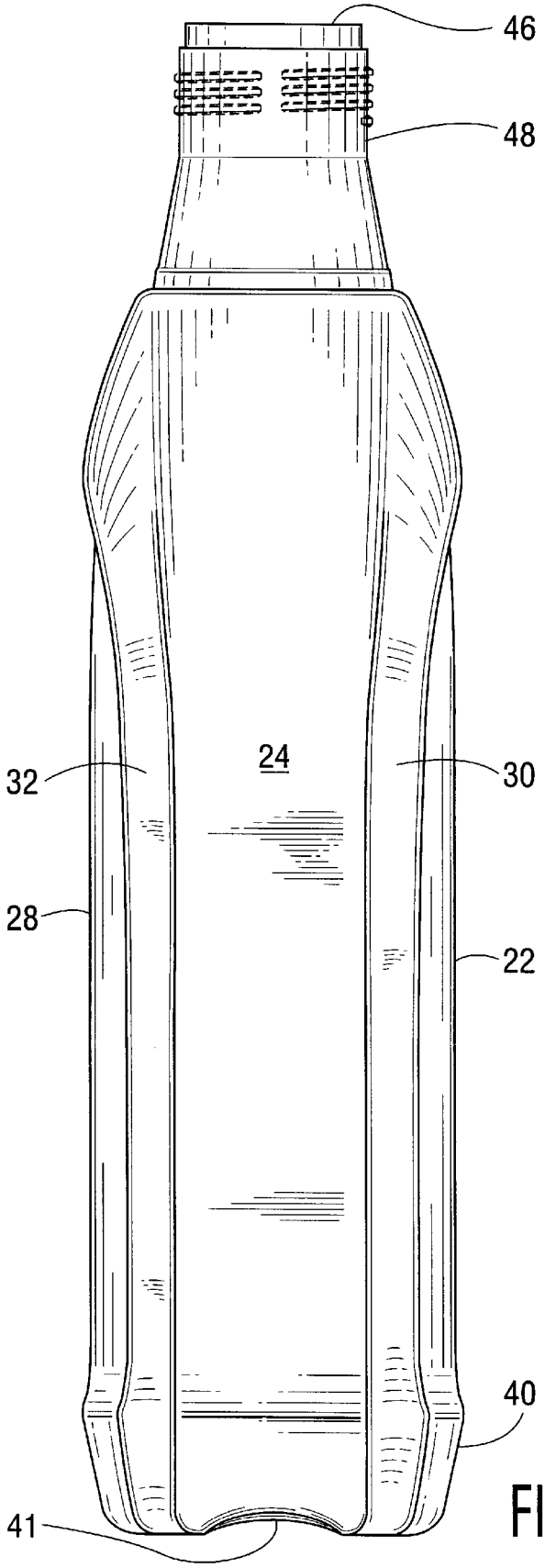
FIG. 2 is a left side elevational view of the container.

FIG. 2 is a view of the left side of the container. There is shown here left sidewall 24 in more detail. Also shown is rear wall 28, concave transition wall 32 connects the rear wall and left sidewall. In this view it is seen that the concave transition walls extend down and through the base 40. Also shown is single concave recess 41 in the base of the container. This concave recess strengthens the bottom of the bottle.

Figure 3:
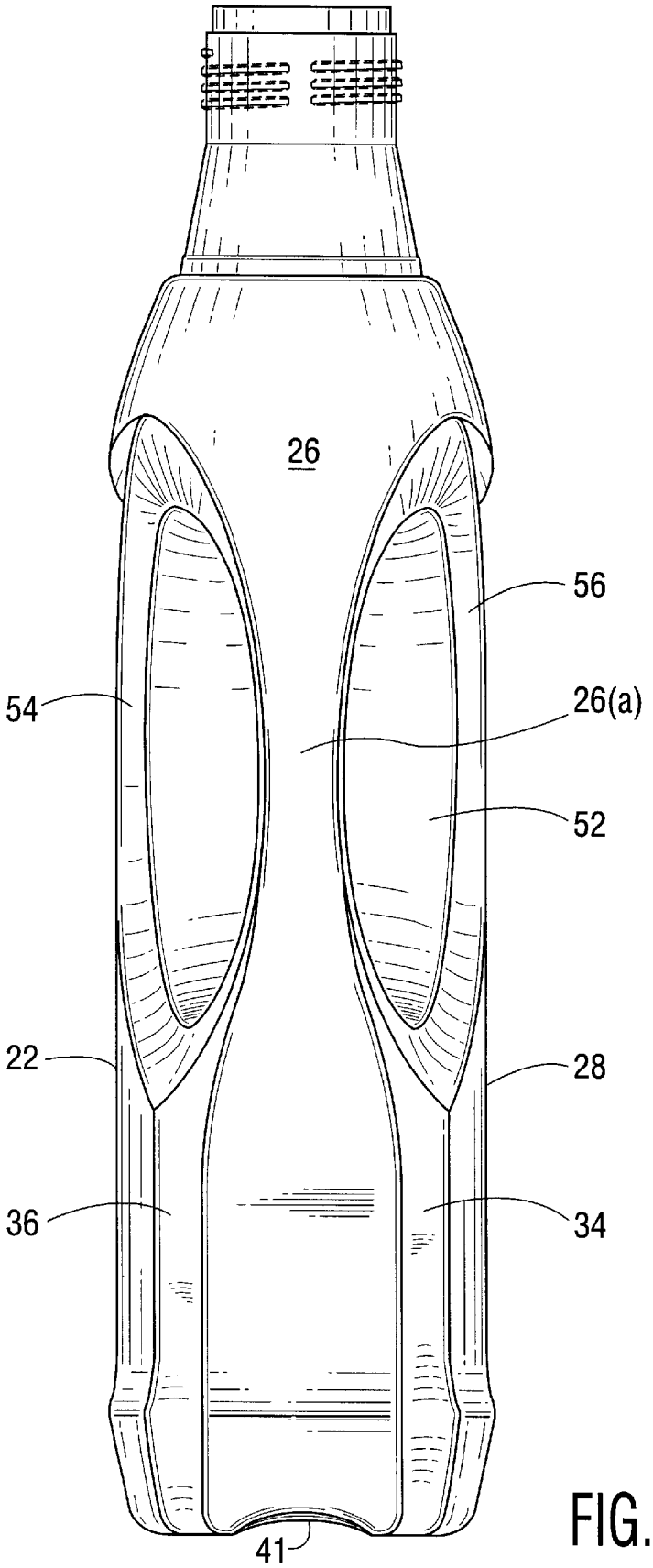
FIG. 3 is a right side elevational view of the container.

In FIG. 3 there is shown a view of the left side of the container. The aperture wall 52 and the concave aperture transition wall is shown in more detail in this view. This concave aperture transition wall strengthens the handle, and in particular, area 26(*a*) of sidewall 26 which comprises a part of the handle. The concave aperture transition walls and the relatively narrow portion 26(*a*) serve to form a strengthened vertical column in this part of the container. Such a vertical column feature increases the longitudinal strength of this side of the container by a more effective transfer of forces to the base.

Figure 4:
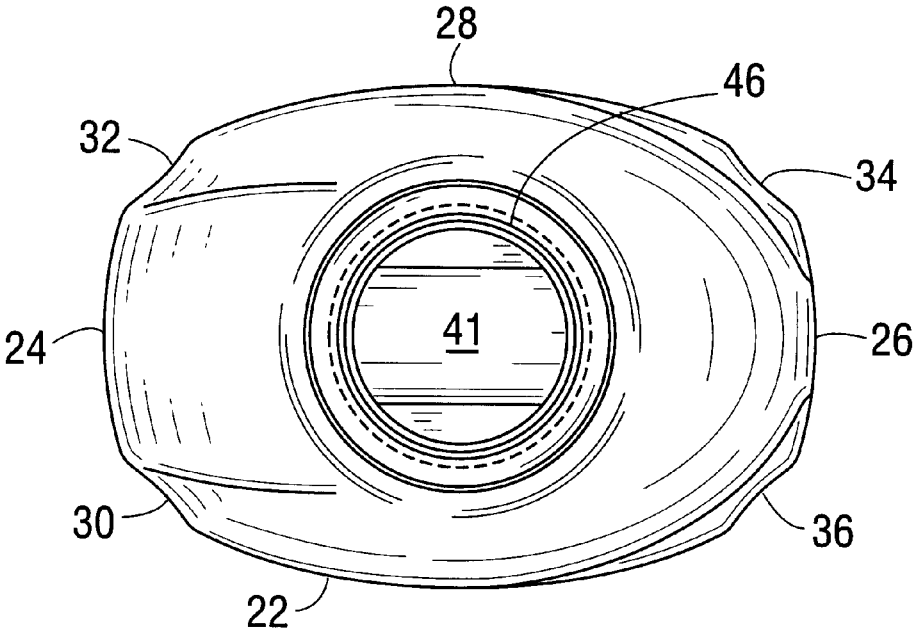
FIG. 4 is a top plan view of the container.

FIG. 4 is a is a top plan view of the container. This view shows each of the walls and the concave recess 41 in the bottom of the bottle.

Figure 5:
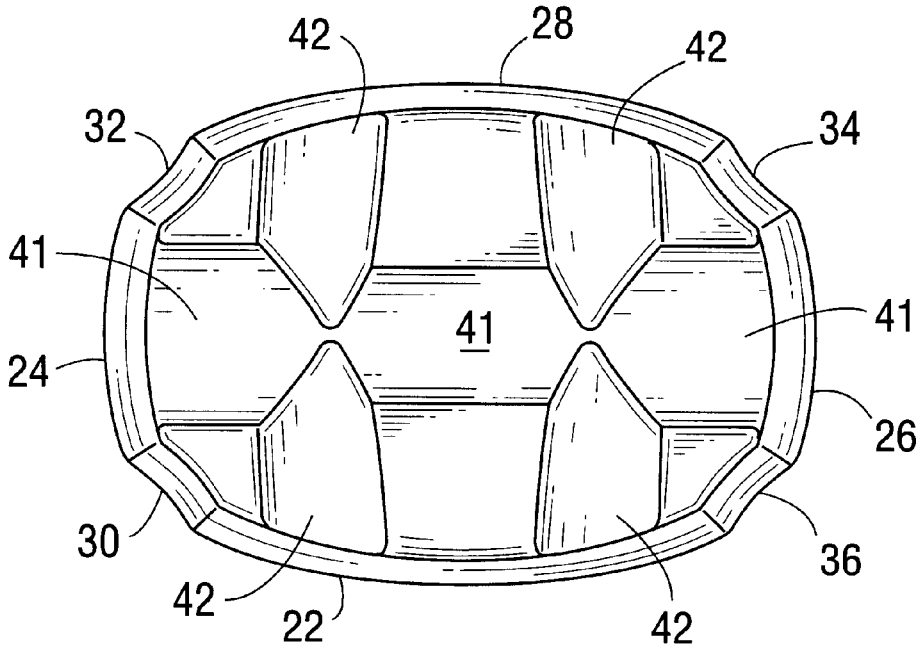
FIG. 5 is a bottom plan view of the container.

FIG. 5 is a bottom plan view of the container. This shows the short lateral concave recesses 42 and the longer lateral recess 41. Each of the short concave lateral recesses merges into the longer concave lateral recess.

Figure 6:
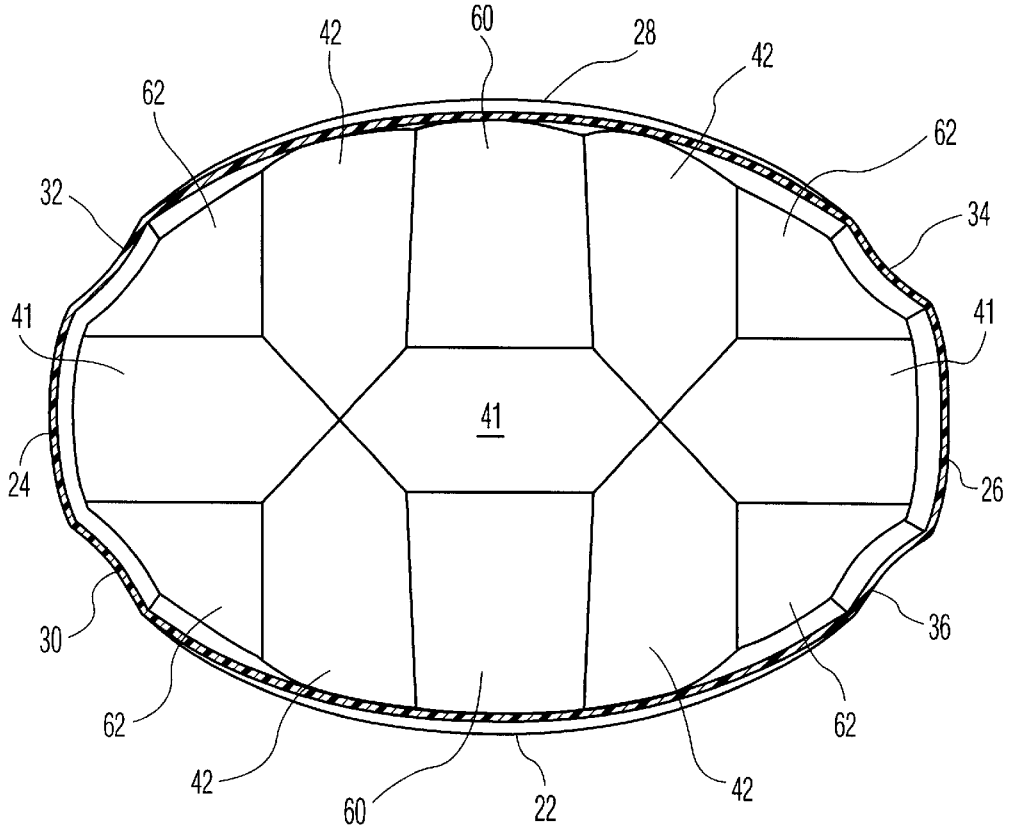
FIG. 6 is a cross-sectional view of the container along line 6—6 of FIG. 1.

FIG. 6 is a is a cross-sectional view of the container of FIG. 1 through line 6—6. This view shows the container body concave transition walls 30, 32, 34 and 36 in more detail. The structure of the bottom surface also is shown in more detail. Lateral concave recesses 41 and 42 form a plurality of container support surfaces 60 and 62.

Figure 7:
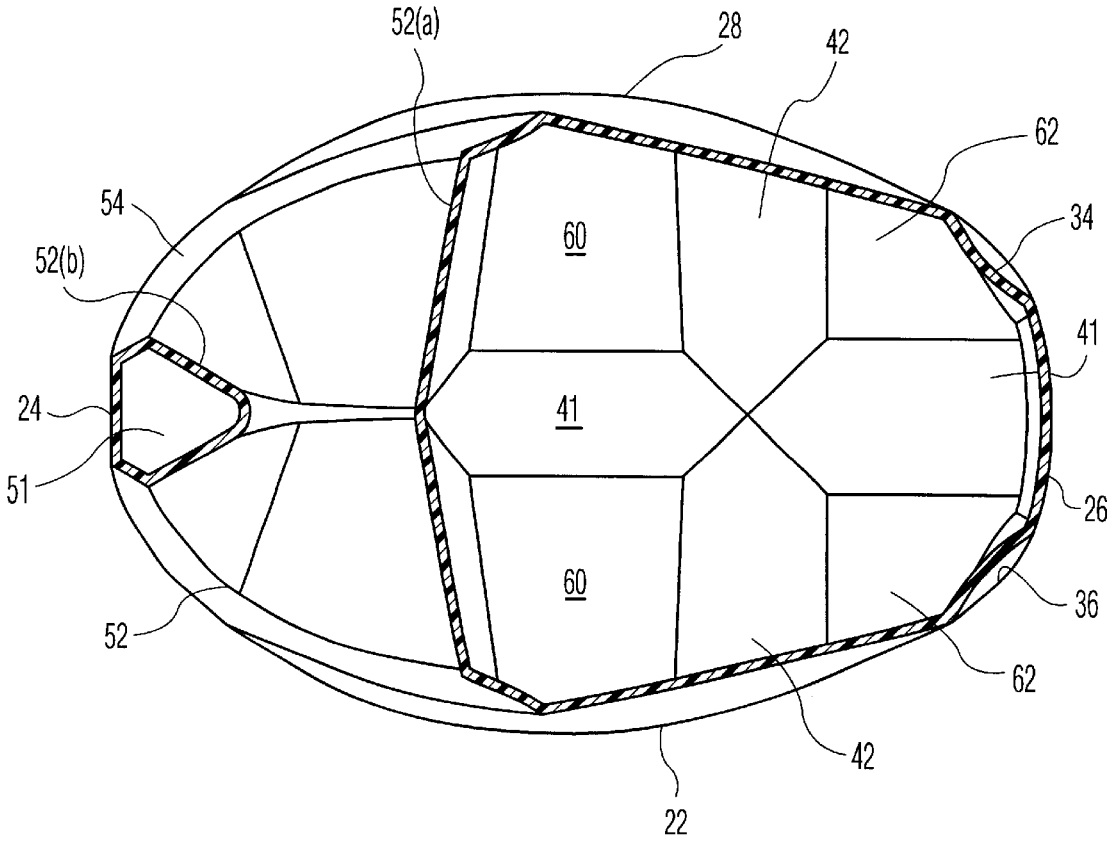
FIG. 7 is a cross-sectional view of the container along line 7—7 of FIG. 1.

FIG. 7 is a is a cross-sectional view of the container along line 7—7 of FIG. 1. This shows the front wall 22 and rear wall 28 and the concave transition walls. Also shown in detail is the handle area. Wall 52(*b*), concave aperture transition walls 54 and 56, and sidewall 24 enclose area 51 which is essentially a hollow vertical column. The wall 52(*b*) has a concave shape which provides additional strength. The aperture wall 52(*a*) is the wall between the main body of the container and the crescent-shaped handle aperture 50. The features of the bottom surface also are shown in this view.

Figure 8:
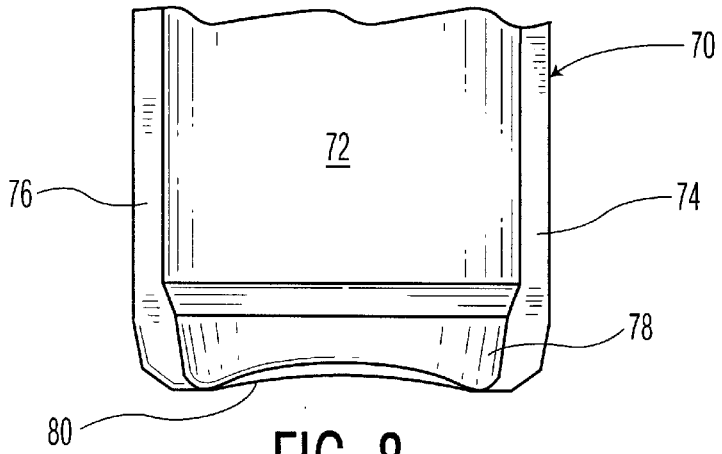
FIG. 8 is a front view of an alternate bottom wall of the container.
Figure 9:
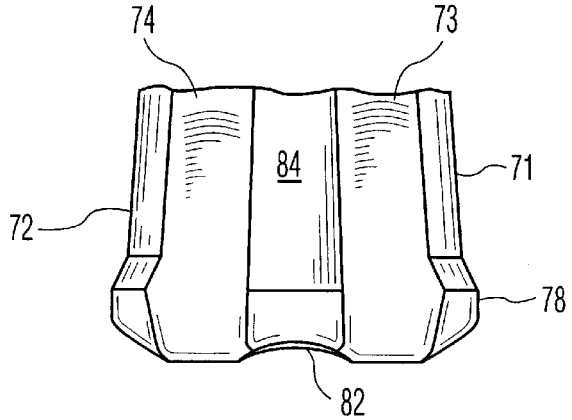
FIG. 9 is a side view of the alternate bottom wall of the container.
Figure 10:
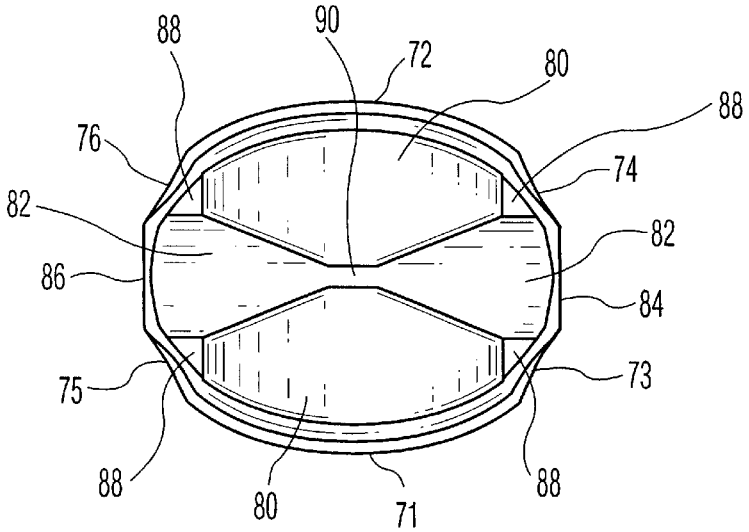
FIG. 10 is a bottom plan view of the alternate bottom wall of the container.

FIGS. 8 through 10 shows an alternate base for the container. Here container 70 has a front wall 72 and a rear wall 71. There are shown two concave body transition walls 74 and 76. These separate the front wall from the sidewalls 84 and 86 respectively. The base portion 78 has a single short lateral concave recess. In FIG. 9 there is shown a side view of this bottle base. Sidewall 84 is abutted by concave transition walls 73 and 74 which separate this sidewall from rear wall 71 and front wall 72 respectively. There also is shown a single long lateral concave recess 82 in the base.

FIG. 10 shows this alternate base in more detail. The concave recesses are shown in more detail. These recesses create container support surfaces 88 and 90.

By the use of concave shaped surfaces in the base and in the body of the container, a container can be produced that used a decreases amount of plastic. The weight of the bottle can be reduced up to 25%. The concave surfaces are strong surfaces and form a strong body portion and bottom to the container. The upper part of the container being comprised of hyperbolic surfaces provides for a strong upper portion and a good technique for transferring a weight placed on the top of the container down the various walls to the base. This is a weight seen many times in the stacking of the containers.

The containers can be constructed from a wide range of materials. The preferred materials are plastics, and preferably, polyolefin monomers and copolymers and polyesters. Suitable polyolefins include polyethylenes, polypropylenes, the vinyl polymers such as vinyl chloride, vinyl acetate and vinyl alcohol polymers, and various copolymers of these polymers. Suitable polyesters include polyethylene terephthalate and polybutylene terephthalate.

Various modifications can be made to the concepts of the present invention. However, these are within the present disclosure which sets out how to produce a strong container using less container structured material.

What is claimed is:

1. A container comprising a front wall, a rear wall and sidewalls joining said front wall and said rear wall, a bottom wall closing a bottom end of said container and a dispensing channel at a top end of said container, a concave transition wall at each junction of said front wall and said rear wall with said sidewalls, a handle aperture in said front wall which extends to said rear wall, an aperture wall connected to said front wall and to said rear wall, a concave front aperture transition wall connecting said front wall to said aperture wall and a concave rear aperture transition wall connecting said rear wall to said aperture wall, whereby said concave transition walls form strengthened portions thereby increasing the longitudinal and lateral strength of said container, wherein the concave aperture transition walls have a concave exterior surface.

2. A container as in claim 1 wherein said aperture is elliptical in shape.

3. A container as in claim 1 wherein said bottom wall has at least one longitudinal concave portion and at least one lateral concave portion.

4. A container as in claim 3 wherein said bottom wall has at least two lateral concave portions.

5. A container as in claim 1 wherein a portion of said handle is comprised of one of said sidewalls of said container, said portion of said handle comprising a substantially vertical column to thereby increase the longitudinal strength of said container.

6. A container comprising a front wall, a rear wall and sidewalls joining said front wall and said rear wall, a bottom wall closing a bottom end of said container and a dispensing channel at a top end of said container, a concave transition wall at each junction of said front wall and said rear wall with said sidewalls, an aperture in said front wall which extends to said rear wall with an aperture wall connected to said front wall and to said rear wall to form an integral handle, a concave front aperture transition wall connecting said front wall to said aperture wall and a concave rear aperture transition wall connecting said rear wall to said aperture wall, said concave transition walls extending from said bottom wall up to at least about half the distance to said dispensing channel, with said concave transition walls forming strengthened portions of said container thereby increasing the longitudinal and lateral strength of said container, wherein the concave aperture transition walls have a concave exterior surface.

7. A container as in claim 6 wherein said concave transition walls merge into the structure of said container in an upper portion of said container.

8. A container as in claim 6 wherein said aperture is crescent in shape.

9. A container as in claim 6 wherein a portion of said handle is comprised of one of said sidewalls of said container, said portion of said handle comprising a substantially vertical column to thereby increase the longitudinal strength of said container.

10. A container as in claim 6 wherein said bottom wall has at least one longitudinal concave portion and at least one lateral concave portion.

11. A container as in claim 10 wherein said bottom surface has at least two lateral concave portions.

* * * * *